US009475174B2

(12) United States Patent
Hursen

(10) Patent No.: US 9,475,174 B2
(45) Date of Patent: Oct. 25, 2016

(54) METHOD AND APPARATUS FOR SOIL EXCAVATION USING SUPERSONIC PNEUMATIC NOZZLE WITH WEAR TIP AND SUPERSONIC NOZZLE FOR USE THEREIN

(76) Inventor: Thomas Francis Hursen, Allison Park, PA (US)

( * ) Notice: Subject to any disclaimer, the term of this patent is extended or adjusted under 35 U.S.C. 154(b) by 1996 days.

(21) Appl. No.: 12/605,305

(22) Filed: Oct. 23, 2009

(65) Prior Publication Data

US 2010/0102139 A1 Apr. 29, 2010

Related U.S. Application Data

(60) Provisional application No. 61/107,833, filed on Oct. 23, 2008.

(51) Int. Cl.

| | |
|---|---|
| ***B24C 5/04*** | (2006.01) |
| ***B24C 7/00*** | (2006.01) |
| ***E21B 7/18*** | (2006.01) |
| ***B05B 1/00*** | (2006.01) |

(52) U.S. Cl.

CPC ..... *B24C 5/04* (2013.01); *B24C 7/0046* (2013.01); *E21B 7/18* (2013.01); *B05B 1/005* (2013.01)

(58) Field of Classification Search

CPC ..... B24C 5/04; B24C 7/0046; E21B 7/18; B05B 1/005

USPC ..... 239/11, 271, 288, 288.3, 288.5, 532, 239/589, 591, 601; 175/67, 209, 325.1, 175/325.5, 424; 299/17

See application file for complete search history.

(56) References Cited

U.S. PATENT DOCUMENTS

| | | | | |
|---|---|---|---|---|
| 4,091,999 | A * | 5/1978 | Voos | 239/289 |
| 4,494,618 | A * | 1/1985 | Radtke | 175/393 |
| 4,776,731 | A | 10/1988 | Briggs | |
| 4,813,611 | A | 3/1989 | Fontana | |
| 4,936,031 | A | 6/1990 | Briggs | |
| 4,991,321 | A | 2/1991 | Artzberger | |
| 5,140,759 | A | 8/1992 | Artzberger | |
| 5,170,943 | A * | 12/1992 | Artzberger | 239/532 |
| 5,212,891 | A * | 5/1993 | Schuermann et al. | 37/323 |
| 5,361,855 | A | 11/1994 | Schuermann et al. | |
| 5,487,229 | A | 1/1996 | Nathenson et al. | |
| 5,782,414 | A | 7/1998 | Nathenson | |
| 5,860,232 | A | 1/1999 | Nathenson et al. | |
| D408,830 | S | 4/1999 | Nathenson et al. | |
| 6,014,790 | A | 1/2000 | Smith et al. | |
| 6,132,497 | A | 10/2000 | Conklin | |
| 6,438,874 | B1 | 8/2002 | LaBounty et al. | |
| 6,540,304 | B2 | 4/2003 | Southern | |
| 6,618,966 | B2 * | 9/2003 | Russo et al. | 37/335 |
| 6,845,587 | B2 | 1/2005 | Smiley | |

(Continued)

*Primary Examiner* — Ryan Reis
(74) *Attorney, Agent, or Firm* — Blynn L. Shideler; Krisanne Shideler; BLK Law Group

(57) ABSTRACT

A tool suitable for soil excavation that can be used in a number of distinct applications is disclosed, wherein the tool includes a sonic or supersonic pneumatic nozzle assembly comprising a converging-diverging cylindrical nozzle body having an internal through passage with inlet on the converging side and an outlet on the diverging side of the nozzle body; and a replaceable cylindrical wear tip removably coupled to the nozzle body and with an internal through passage aligning with the outlet of the nozzle body, and wherein an outside form of the wear tip is configured to direct reverse sand blasting particles away from the external surfaces of the nozzle body.

19 Claims, 5 Drawing Sheets

(56) References Cited

U.S. PATENT DOCUMENTS 6,988,586 B1 1/2006 Perez
7,234,252 B2 6/2007 Jarnecke et al.
2007/0202781 A1* 8/2007 Robinson ..... 451/102
2008/0093125 A1* 4/2008 Potter et al. ..... 175/67

* cited by examiner

FIG. 4B
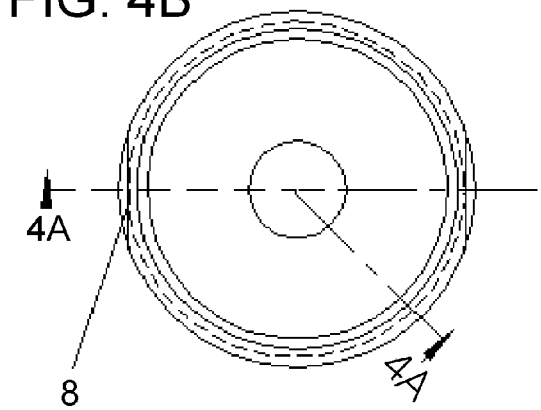
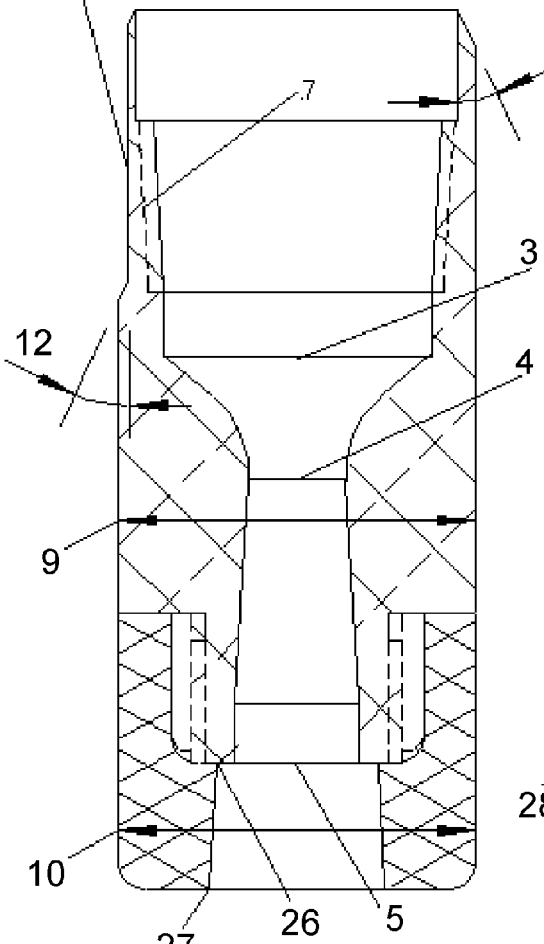
FIG. 4A
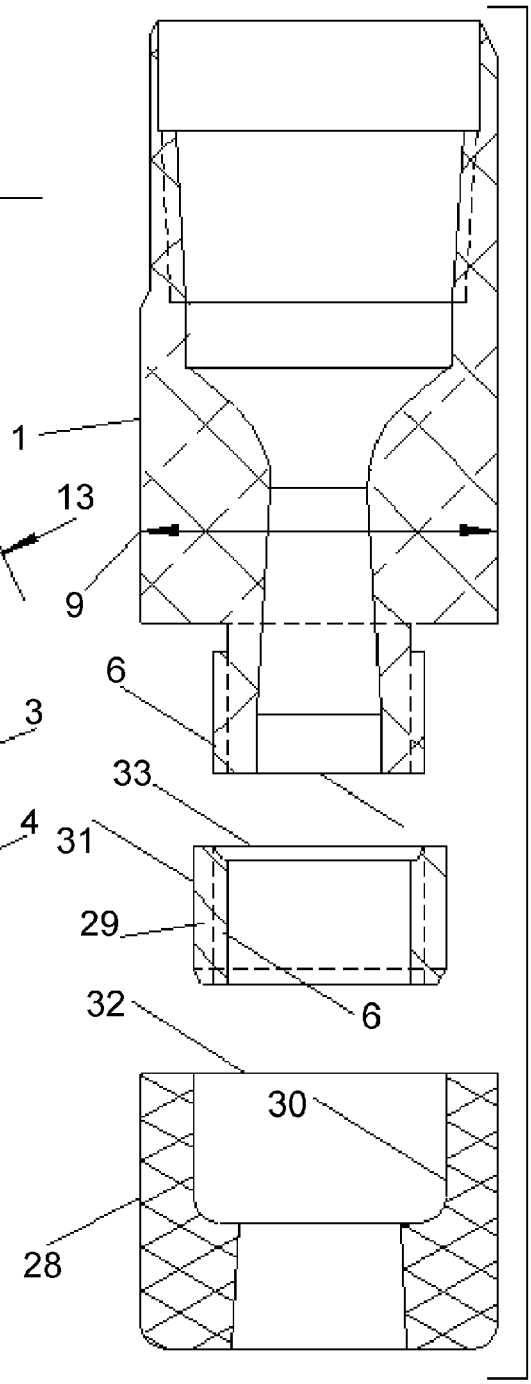
FIG. 4C

METHOD AND APPARATUS FOR SOIL EXCAVATION USING SUPERSONIC PNEUMATIC NOZZLE WITH WEAR TIP AND SUPERSONIC NOZZLE FOR USE THEREIN

RELATED APPLICATIONS

The present application claims the benefit of provisional patent application Ser. No. 61/107,833 filed Oct. 23, 2008 entitled "Method and Apparatus for Soil Excavation using Supersonic Pneumatic Nozzle with Wear Tip and Supersonic Nozzle with Wear Tip for use therein.

BACKGROUND OF THE INVENTION

1. Field of the Invention

The present invention relates to soil excavation using supersonic nozzles, in particular to a method and apparatus for soil excavation using supersonic pneumatic nozzle with wear tip and supersonic pneumatic nozzle with wear tip for use therein.

2. Background Information

U.S. Pat. No. 5,782,414, which is incorporated herein by reference, notes that it has been well known that compressed air released in close proximity to and directed toward the ground can result in loosening of a number of types of soil. A pneumatic soil excavation tool, also called a wand, consisting of a valve, length of pipe or tubing, and ending in a reduced sized nipple or nozzle, supplied with air from a standard portable compressor, is commonly used for the purposes of dislodging soil safely from around underground utilities such as gas, water, or sewer pipes and electric, telephone, television, or other cables. The compressed air does not pose a hazard of damaging the buried utility as does a pick, digging bar, spade, bucket, or blade.

The ability to unearth safely other types of buried objects is also important. For example, in the industrial or nuclear energy sectors, such objects include glass bottles, cardboard or wood boxes, metal or fiber drums, or metal cylinders of chemical or radioactive waste. From the military sector, objects include all types of unexploded ordnance or chemical munitions.

A number of tools have been marketed produce an air stream for improved digging purposes by making the air exit the tool at a supersonic speed. For example, U.S. Pat. No. 4,813,611, which is incorporated herein by reference, discloses a compressed air nozzle for use in soil excavation to uncover buried pipes, electrical cables and the like. U.S. Pat. No. 5,170,943 discloses a similar tool with a handle, valve, electrically insulating barrel, and a nozzle. The '943 patent includes a conical shield to protect the operator, but nothing to protect the nozzle. U.S. Pat. No. 5,212,891 discloses a further excavating pneumatic nozzle design.

Air excavation nozzles should not be confused with the rocket nozzles. Supersonic air excavation nozzles used for excavation purposes are different than rocket nozzles in a number of important ways. Supersonic air nozzles for earth excavation operate at significantly lower pressures and temperatures than rocket nozzles. For example, a rocket's chamber pressure may reach 1,000 to 3,000 psig and the exhaust gas temperature may be 1,800° to 7,700° F., while typical gas jet excavation nozzles operate at around 100 to 200 psig and at 80° to 140° F. The velocity of the exhaust gas exiting from a chemical rocket's nozzle may be from 6,000 to 14,000 ft/sec; while for an excavation nozzle typical values are from 1,700 to 2,000 ft/sec. The specific nozzle profile for a typical rocket nozzle is, thus, significantly different in shape than for an air excavation nozzle.

U.S. Pat. No. 6,845,587 describes the practices of revival woody plants that are in decline, which is usually preferred to replanting. Revival avoids costs for removal and additional costs for replacement. Typically, revival has meant either aggressively fertilizing the subject plant and/or loosening the soil. Revival success is dependent on the degree of soil compaction and existing moisture content. Earlier methods include laboriously exposing roots using trowels and small digging implements. Once exposed, the roots were reburied with new loose soil or covered with the existing soil now more loosened. This early, labor intensive method is similar to the way archeologists dig for shards of pottery—slow and tedious. An improvement over manual excavation is a vertical mulching technique where a grid of 1 to 2 inch holes is drilled in the rooting soil. The holes are then backfilled with porous material and/or fertilizer.

One technique of soil loosening uses compressed air. Compressed air released at supersonic speed fractures the soil, with minimal damage to roots. Unlike porous soil, non-porous matter, such as roots, remain minimally damaged by the compressed air. Soil fracturing avoids the problems of mechanical excavation.

Fracturing soil by using compressed air is popularly used on lawns and turfs, such as golf courses. To maximize efficiency compressed air is injected in a grid. The grid is spaced so to aerate the soil evenly throughout a specified area by fracturing the soil.

Specifically U.S. Pat. No. 6,845,587 provides for the provision of a method of improving the rooting soil of a woody landscape plant comprising the steps of exposing a root collar of a plant; defining a first improvement zone encompassing the root plate area; excavating the first improvement zone with an air excavator; and adding a beneficial treatment to the first improvement zone.

The above description illustrates the growing applications for pneumatic supersonic soil excavation tools. However, the observation and analysis of damage to the exterior of various supersonic nozzles, particularly the relatively rapid failure of nozzles used during excavation of the ground, has demonstrated a need for improvement. The damage to the nozzle exterior is best described as erosion, presumably as the result of back flow of hard particles in the soil that impact the nozzle exterior with sufficient velocity and hardness to wear away (erode) the nozzle exterior. This blow back does not erode the nozzle expansion exit because the air jet coming from the nozzle expansion exit is the highest velocity in the nozzle region, and any nearby rebounding air/particles are simply drawn into the exiting air stream before it/they can reach the nozzle expansion exit. But the backflow air, when it contains sufficiently hard particles, and sufficient velocity, can and will erode the nozzle exterior.

The supersonic exit stream from the nozzle begins losing velocity, and thus digging effectiveness, as soon as the stream leaves the nozzle exit. Thus the typical digging function is performed by placing and keeping the nozzle exit, as close as possible, to the ground being excavated. This, of course, also keeps the nozzle exterior as close as possible to any high velocity back flow or blow back. When this back flow contains particles of sufficient hardness to erode any typical metal, such as stainless steel, anodized aluminum, brass etc., it is a matter of relatively brief time (e.g., days or weeks) to nozzle failure.

Experience shows that materials as hard as ordinary sand are very effective in eroding metals. Consequently this effect may also be termed as "reverse sand blasting". The inventors of this application have experienced that this effect is seen at its worst when working in sand, in places such as middle eastern desserts. However the effect is perceptible in any soil that has sufficient content of such hard particles. Thus the occurrence and extent of the problem is difficult to predict. For, example the inventors of this application have also experienced this reverse sandblasting nozzle failure effect when working with air excavation tools in areas such as Ohio, many miles from the nearest large body of water, where one might ordinarily expect sandy beaches. Many geologic conditions can lead to soils containing small hard particles, similar to sand. An example is long term wind or water erosion of rock. It is believed that any hard particles in the soil will increase the reverse sand blasting effect on the nozzle.

Typical supersonic nozzle designs, as evidenced in the above cited patents usually focus on the interior of the nozzle design, in part because of the difficulty of these designs, and their tendency to be sophisticated, and the exterior has been left to the casual discretion of the designer. In some cases, the exterior design has been the subject of design patent protection, see for example U.S. Design Pat. No. D408,830, while there has been a functional need for a more utilitarian approach to nozzle exterior construction lurking in the soil.

FIG. 1 is a reproduction of an isometric figure from issued U.S. Design Pat. No. D408,830 and is an accurate representation of a commercially available air excavation nozzle that has been used for many years as the exterior of a supersonic nozzle used in excavation. This nozzle design is emblematic of the undesirable characteristics that the present invention solves. The integral nozzle tip outside diameter is smaller then the body of the nozzle, which exposes that nozzle body to reverse sand blasting erosion. This resulting nozzle body flat presents a perfect reverse sand blasting target. A similar perfect target is presented at the exterior end of the wrench flats that precede the trailing balance of the nozzle body. Further, the rear end of this nozzle is blunt, thereby presenting a likely snagging surface as the nozzle is withdrawn from soil.

FIGS. 2A and 2B illustrate a commercially available prior art supersonic pneumatic nozzle that was put in service with out any of the protective features of the present invention. The nozzle was used in shallow trenching in sandy soil. The nozzle tip was integral with the nozzle body. The extent of the actual reverse sand blasting erosion to the wear tip and the nozzle is illustrated by tightly spaced shading. This erosion was sufficiently severe within a month to carry the erosion through the nozzle exterior into the nozzle interior, near the nozzle entrance, as shown. In other words, nozzle failure occurred within a month of active service in a sandy environment.

It is an object of the present invention to provide a supersonic air excavation nozzle that alleviates at least some of the above stated problems associated with reverse sand blasting.

SUMMARY OF THE INVENTION

The above object is achieved with the embodiments according to this invention, which include is a supersonic pneumatic nozzle assembly with a wear tip formed of an especially hard, erosion resistant material. The erosion or wear resistant material may be carbide material such as Cerbide™ material (a polycrystalline tungsten carbide), any cemented carbide, or carbide(s), of boron, titanium, tungsten or other highly wear resistant formulations. The nozzle body and the wear tip of the nozzle assembly are both generally cylindrical in exterior shape, and where an outside diameter of the wear tip is (1) approximately equal to or larger than any external diameter of the nozzle body, or otherwise shadows all of the nozzle body exterior; or (2) includes a leading edge deflecting surface to deflect "reverse sand-blasted particles" away from the nozzle body, or (3) both. When such a nozzle assembly is used for excavation, the purpose of this structure is to resist the action of high velocity air, rebounding from the ground with entrained hard particles that can erode the nozzle body exterior, thus leading to nozzle assembly failure.

One aspect of the invention can be described as providing a pneumatic nozzle assembly comprising a nozzle body having an internal through passage with inlet on the a first side and an outlet on an opposed side of the nozzle body; and a replaceable cylindrical wear tip removably coupled to the nozzle body and with an internal through passage aligning with the outlet of the nozzle body, and wherein an outside form of the wear tip is configured to direct reverse sand blasting particles away from the external surfaces of the nozzle body.

The invention may provide that the nozzle body is a converging-diverging cylindrical nozzle body having the inlet on the converging side and the outlet on the diverging side of the nozzle body; and wherein an outside diameter of the wear tip is greater than or equal to any external diameter of the nozzle body to direct reverse sand blasting particles away from the external surfaces of the nozzle body. The outside diameter of the wear tip may, in one embodiment, be greater than the external diameter of the nozzle body along a first section of the wear tip beginning at the end of the wear tip opposed from the nozzle body, and with the wear tip further including a smooth transitional shape from a widest part of the wear tip to a distal end of the nozzle body to minimize snagging of the nozzle assembly on buried objects in use.

The invention may provide that the internal through passage of the wear tip aligning with the outlet of the nozzle body has a diameter substantially equal to or larger than the outlet at a position adjacent the outlet. Further the invention may provide that the interior of the wear tip, closest to the nozzle body outlet, is sufficiently close to the physical inside diameter of the nozzle body outlet, whereby any rebounding air stream carrying hard particles from the ground being excavated is readily drawn into the exiting supersonic jet and ejected. The invention may provide that the internal through passage of the wear tip aligning with the outlet of the nozzle body has diverging shape such that any rebounding air stream carrying hard particles in that region from the ground being excavated is directed towards the exiting air jet.

The invention may provide an intermediate adaptor attached to the nozzle body to facilitate removable attachment to the nozzle body.

The invention may provide that the nozzle body is a converging-diverging cylindrical nozzle body having the inlet on the converging side and the outlet on the diverging side of the nozzle body; wherein a largest outside diameter of the wear tip is less than the external diameter of the nozzle body, wherein the wear tip includes a leading end of the wear tip beginning opposite of the nozzle body which is outwardly tapered from the distal end of the wear tip toward the nozzle body to direct reverse sand blasting particles away from the external surfaces of the nozzle body.

Another aspect of the invention provides a method of soil excavation comprising the steps of: providing a pneumatic nozzle assembly comprising a converging-diverging nozzle body having an internal through passage with inlet on the converging side and an outlet on the diverging side of the nozzle body, and a wear tip removably coupled to the nozzle body and with an internal through passage aligning with the outlet of the nozzle body; and directing reverse sand blasting particles away from the external surfaces of the nozzle body through the use of the wear tip. The invention may provide the step of providing supersonic flow from the pneumatic nozzle.

The method of soil excavation of claim 18 wherein an outside diameter of the wear tip is greater than or equal to any external diameter of the nozzle body to direct reverse sand blasting particles away from the external surfaces of the nozzle body.

An alternate embodiment of the present invention is similar, but uses any typical metal for either or both the pneumatic nozzle body and the wear tip, with provision of a wear tip outside diameter that exceeds any outside diameter of the nozzle body to provide sacrificial and temporarily protective material for the nozzle body, plus a suitable wear tip forward extension.

These and other advantages of the present invention will be clarified in the description of the preferred embodiments taken together with the attached drawings in which like reference numerals represent like elements throughout.

BRIEF DESCRIPTION OF THE DRAWINGS

Other objects and advantages appear in the following description and claims. The enclosed drawings illustrate some practical embodiments of the present invention, without intending to limit the scope of the invention or the included claims.

FIG. 4A is a section elevation side view of a soil excavating supersonic pneumatic nozzle body and wear tip according to another embodiment of the present invention;

FIG. 4B is a top end view of the nozzle body of FIG. 4A, wherein line 4A-4A illustrates the section line for FIG. 4A;

FIG. 4C is an exploded section elevation side view of the nozzle body and wear tip of FIG. 4A;

DESCRIPTION OF THE PREFERRED EMBODIMENTS

Figure 1:
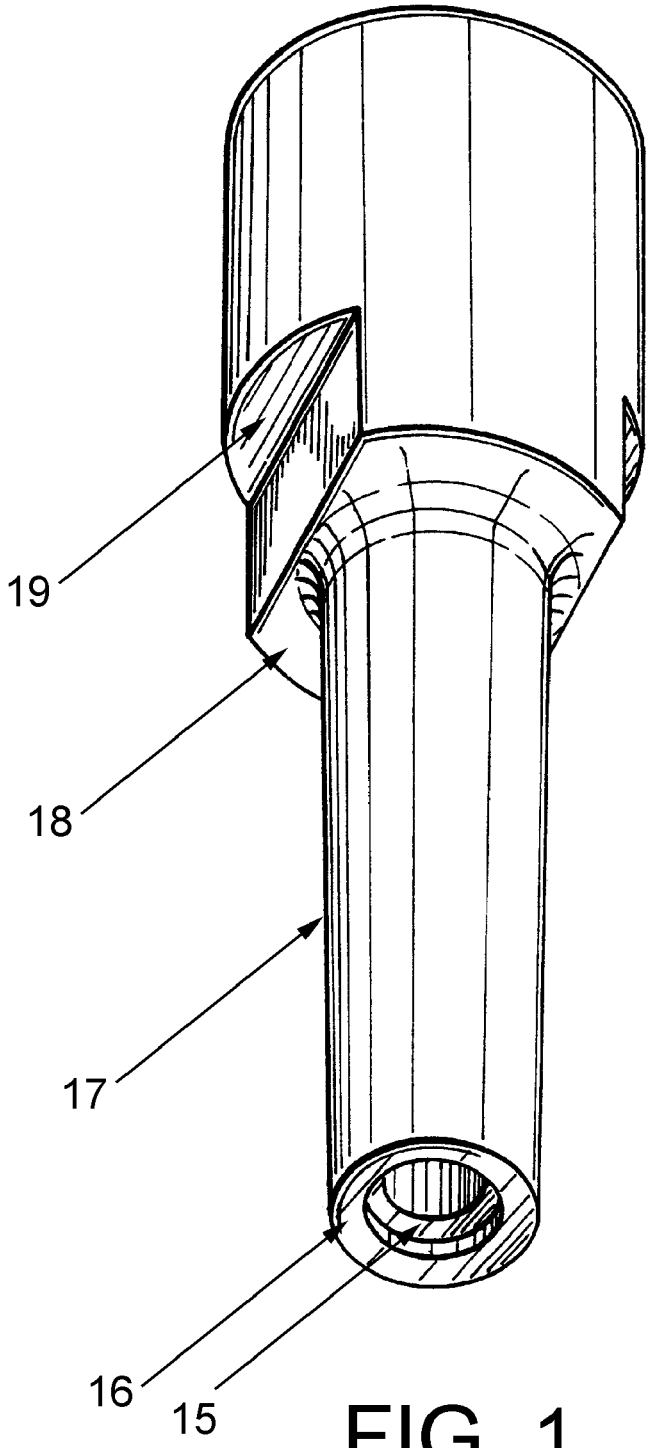
FIG. 1 PRIOR ART
FIG. 1 is a perspective view of a prior art soil excavating supersonic pneumatic nozzle assembly.

FIG. 1 is a view of a prior art nozzle assembly of the prior art as shown in Design patent D408,830 and is representative of a commercially available nozzle design. This prior art figure also illustrates most of the failures with use existing pneumatic nozzle assembly designs for supersonic soil excavations that are addressed by this invention. The prior art nozzle exit 15 of this prior art nozzle assembly design is so close to the integral wear tip leading surface 16, that this prior art wear tip leading surface 16, will be worn away, much more rapidly than either the metal wear tip 2 or the replaceable hard wear tip 28 of the present invention, described below. More significantly, the prior art leading outside diameter 17, is smaller than either the prior art nozzle body shoulder 18 or the prior art wrench flat shoulder 19 of the nozzle body, making both surfaces 18 and 19, reverse sand blasting targets. This exterior type, of a generally smaller diameter forward and larger diameter rearward is typical of existing nozzle assemblies, supersonic or otherwise. In most applications the nozzles are not supersonic nozzles, such as in cleaning applications or injection applications, and in such applications the nozzles do not encounter significant reverse sand blasting effects because they produce air jets of much smaller exit velocity and/or are not used for excavating purposes.

Figure 2B:
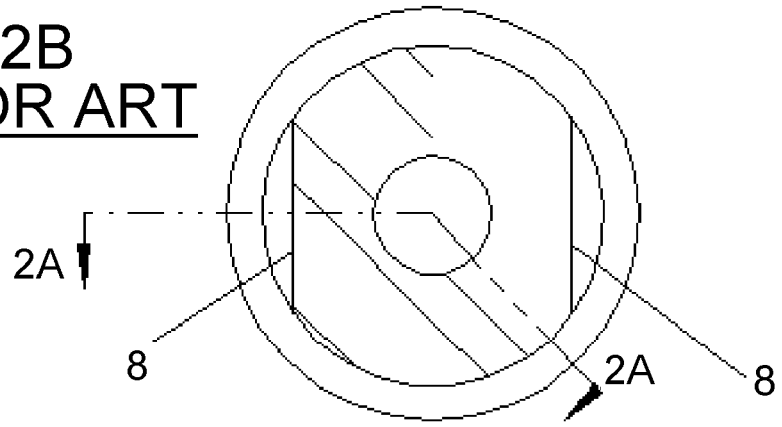
FIG. 2B PRIOR ART
FIG. 2B is a cross-sectional view of the prior art nozzle assembly of FIG. 2A taken along line 2B-2B of FIG. 2A and wherein section line 2A-2A illustrates the section line for FIG. 2A.
Figure 2A:
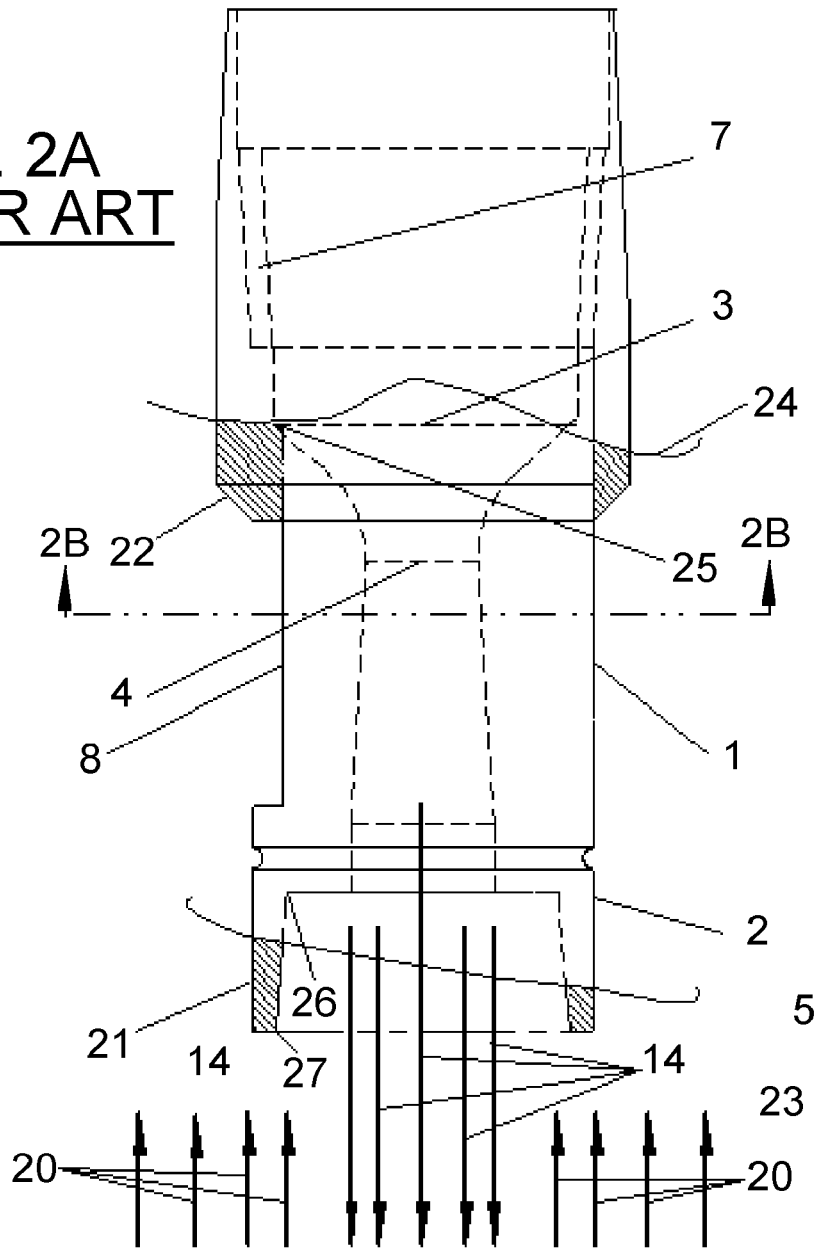
FIG. 2A PRIOR ART
FIG. 2A is a section elevation side view of a prior art soil excavating supersonic pneumatic nozzle assembly.

FIGS. 2A and 2B illustrate an example of another prior art failed supersonic soil excavating pneumatic nozzle construction. This nozzle assembly design has similar nozzle entrance 3, nozzle throat 4, and nozzle expansion exit 5 construction as found in the present invention as described below, however, the external construction of this prior art nozzle body results in premature failure in some soil excavation applications. The design of this nozzle assembly has an integral metal "wear tip" 2 formed of the same metallic material as the body of the nozzle. The metal wear tip 2 does not shadow the balance of the nozzle design, thus both the wear tip eroded material 21 and the nozzle eroded material 22 suffer significantly in a very short time (less than a month) sufficient to cause nozzle failure by erosion, at the erosion into nozzle interior 25. Also, the wrench flats 8 are so far forward that they open a reverse sand blasting target.

Figure 3B:
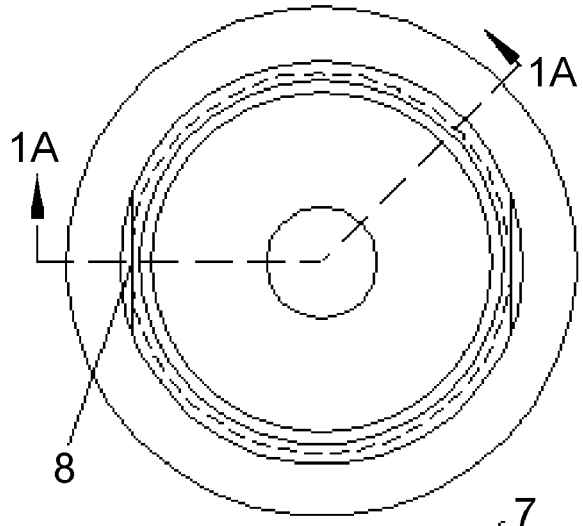
FIG. 3B is a cross-sectional view of the nozzle of FIG. 3A, wherein line 3A-3A illustrates the section line for FIG. 3A.
Figure 3A:
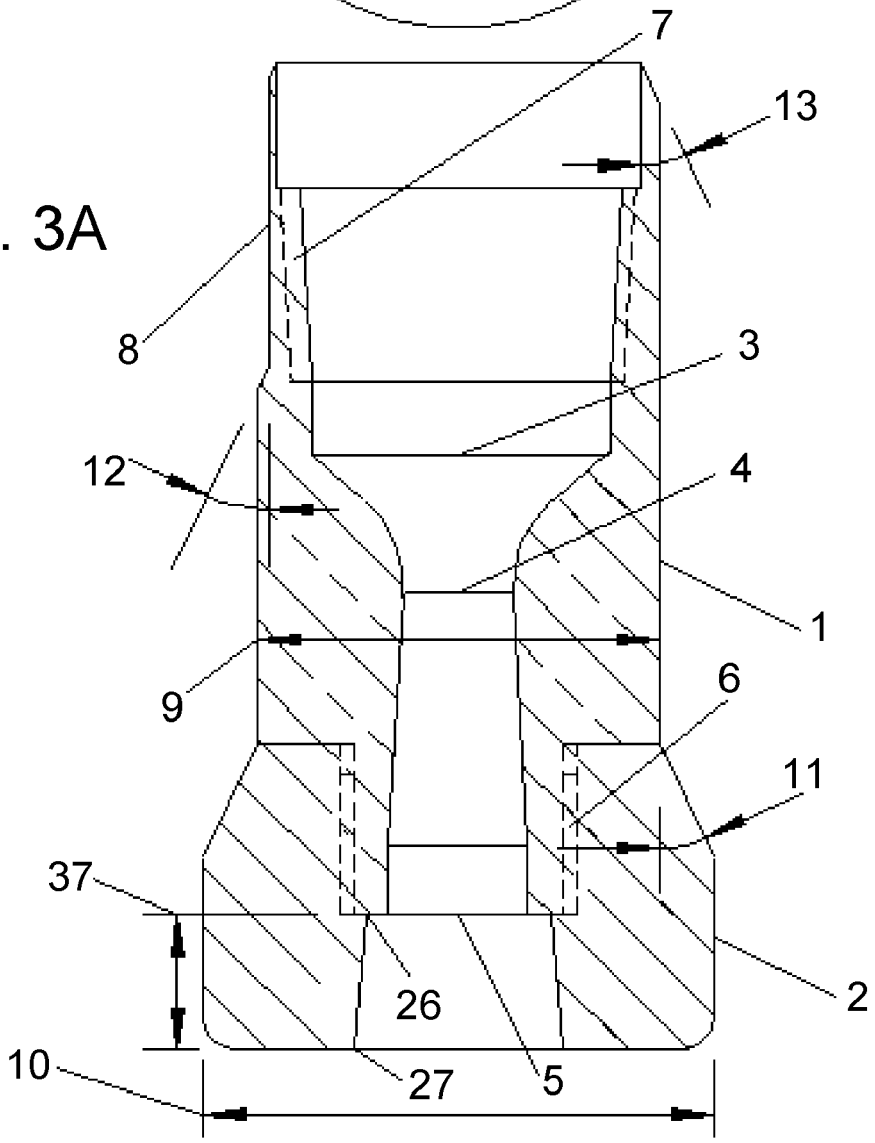
FIG. 3A is a section elevation side view of a soil excavating supersonic pneumatic nozzle body and wear tip according to one embodiment of the present invention.

FIG. 3A is a cross section of one embodiment of a supersonic air nozzle assembly according to one embodiment of the invention, which is a supersonic nozzle body 1, with a removable wear tip 2 of metal, where the wear tip outside diameter 10 is generally larger that the outside diameter 9 of the nozzle body 1, thus protecting the nozzle body 1 from reverse sand blasting. Also, the interior 27 of the forward wear tip 2, is sloped or otherwise contoured to direct any nearby reverse sand blasting materials to be conveyed to the side of the exiting jet so as to protect the nozzle exit 5 from this effect. Also, each anterior transition such as 11, 12 of the nozzle assembly exterior shape is sloped gently relative to the nozzle axis so as to avoid snagging of any of these surfaces on tree roots or other buried objects when the nozzle assembly is being extracted from the soil. FIG. 3B is an end view of FIG. 3A and illustrates it's generally round shape.

FIG. 4A is the cross section of an assembled alternative embodiment of the invention, that uses the very hard wear tip 2 material such as Cerbide™ material, etc. constructed as a removable wear tip, where the outside diameter of the wear tip 10 is equal to or somewhat larger in diameter than the diameter 9 of the nozzle body 1. FIG. 4C is the same embodiment as FIG. 4A, but illustrates each of separate parts, before assembly.

FIGS. 3A and B, 4A and B and 5A and B illustrate three preferred embodiments of a supersonic nozzle assembly having a nozzle body 1 with a wear tip 2 that is used for excavating soil.

Typically, a supersonic nozzle assembly includes a nozzle body 1 which will have a nozzle entrance 3, a constricting nozzle throat 4 operating at sonic flow, a nozzle expansion exit 5 that causes air flow to exit at supersonic speed. In FIG. 3A, the metal wear tip 2 is constructed of any one of several metals that are commonly used to construct nozzles (stainless steel, etc.). The metal wear tip outside diameter 10 is larger than the nozzle body outside diameter 9, both of which are generally cylindrical. This provides a protective and sacrificial material to absorb the reverse sand blasting erosion that occurs when excavating in sandy soils or soils containing significant quantities of small, hard particles, typically the size of sand, that in time, will erode any exposed, forward facing nozzle surface.

This metal wear tip 2, also has a generous metal wear tip extension 37 for the same purpose. If the metal wear tip outside diameter 10 were to be smaller that the nozzle body outside diameter 9, the reverse sand blasting will immediately wear the outside of the wear tip 2 and, more or less simultaneously, the external shape of the nozzle body, as well, as in prior art structures. In surprisingly short time periods (weeks), this can lead to nozzle failure as the nozzle body is worn through to the interior. Conventional supersonic nozzle assemblies in use have leading exterior diameters 17, see FIG. 1, that are smaller in diameter than the trailing nozzle body outside diameter 9, so in the many operating conditions, they wear out quickly.

A similar issue occurs near the nozzle expansion exit 5. This invention places a forward, inclined or curved wear tip inside surface corner 26 sufficiently close to the nozzle expansion exit 5, that any reflected hard particles entrained in reflected air in that region are directed closely towards the exiting air stream, so that those particles are inducted into exiting supersonic air stream and directed away from the nozzle. Also, the inside wear tip entrance corner 27, is placed at an inclined radial location relative to the wear tip inside surface corner 26, in a smoothly inclined relationship, so that reverse sand blasting particles in this region of the tip 2 are directed towards the wear tip inside surface corner 26, thence inducted into that air stream and directed away from the nozzle assembly.

Similarly, any nozzle trailing external surface must be shadowed by the metal wear tip 2, and ideally also by any leading nozzle exterior features. This requires that any wrench flats 8 must be near the rear of the nozzle exterior. Another requirement for the exterior nozzle body 1 and metal wear tip 2 surfaces is they must be connected to the next exterior shape in turn by a taper or other similar shape that has a shallow inclination to the central axis of the nozzle such as the wear tip reverse angle 11, the wrench flat reverse angle 12 and the nozzle end reverse angle 13 so that when the nozzle assembly is being withdrawn from the soil, it will not snag on roots or other buried objects. There needs to be a nozzle to barrel connection 7, so as to receive an air supply of suitable pressure and quantity of flow in a conventional fashion.

FIG. 4A is an assembled, optional embodiment of the nozzle assembly according to the present invention. It has the same or similar nozzle entrance 3, nozzle throat 4, and nozzle expansion exit 5 of FIG. 3A of a supersonic nozzle. It also has the external nozzle features of the nozzle in FIG. 3A, including the same nozzle outside diameter 9, wrench flats 8 with a wrench flat reverse angle 12, and nozzle end reverse angle 13. The nozzle assembly employs a replaceable hard wear tip 28, whose wear tip outside diameter 10, is the same as or somewhat larger than the nozzle outside diameter 9, and where the material of the replaceable hard wear tip 28 is any of a Cerbide™ material, any cemented carbide, or carbide(s), of boron, titanium, tungsten or other extremely hard and highly wear resistant material or combination.

Similar to the embodiment of FIG. 3, this embodiment of FIG. 4A also places an inclined or curved wear tip inside surface corner 26 that is placed sufficiently close to the nozzle expansion exit 5, that any reflected hard particles entrained in reflected air in that region are directed closely towards the exiting air stream, so that those particles are inducted into that air stream and directed away from the nozzle assembly. Also, the inside wear tip entrance corner 27, is placed at an inclined radial location relative to the wear tip 28 inside surface corner 26, in a smoothly inclined relationship, so that reverse sand blasting particles in this region are directed towards the wear tip inside surface corner 26, thence inducted into the supersonic air stream exiting the nozzle assembly, and directed away from the nozzle assembly.

The hard material of the tip 28 resists conventional machining, shapes, such as the one shown, can be formed by hot pressing into a mold and by similar methods. Thus small threads are difficult to form. For this and other reasons of convenience, a metallic wear tip insert 29, containing a threaded wear tip to nozzle connection 6, is pressed into the molded, replaceable hard wear tip 28, so it may be readily attached to a supersonic nozzle 1, previously machined from metal.

FIG. 4C is an exploded view of the assembled optional preferred embodiment of FIG. 4A, for clarity and to indicate the assembly process, as follows. The machined wear tip insert 29, is pressed into replaceable hard wear tip 28, such that the wear tip insert press fit 31 (i.e. the outer diameter surface), has a small interference fit with the wear tip press fit 30 (i.e. the inner diameter surface). The two parts are pressed together until the wear tip alignment surface 32, aligns against the wear tip insert alignment surface 33.

Figure 5B:
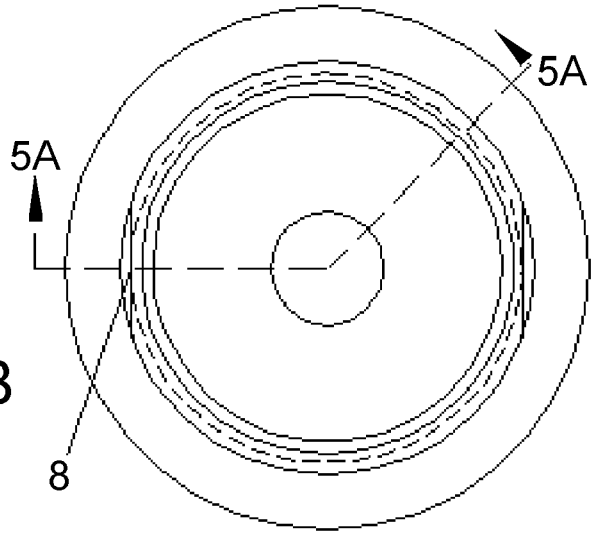
FIG. 5B is a top end view of the nozzle body of FIG. 5A, wherein line 5A-5A illustrates the section line for FIG. 5A.
Figure 5A:
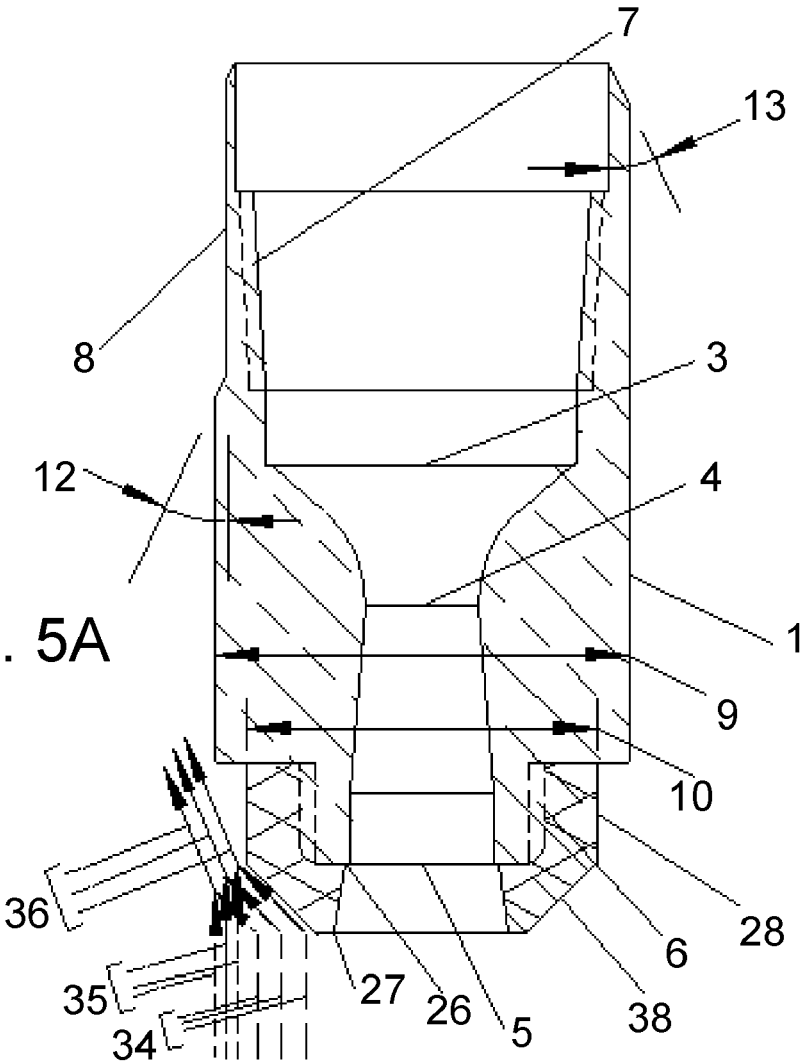
FIG. 5A is a section elevation side view of a soil excavating supersonic pneumatic nozzle body and wear tip according to another embodiment of the present invention.

FIG. 5A is an assembled, optional embodiment of the nozzle assembly of the invention. It has all of the features of FIG. 4A, except that it employs a replaceable hard wear tip 28, whose wear tip outside diameter 10, is smaller than the nozzle outside diameter 9, and where the material of the replaceable hard wear tip 28 is any of a Cerbide™ material, any cemented carbide, or carbide(s), of boron, titanium, tungsten or other extremely hard and highly wear resistant material or combination. Further, this hard wear tip 28 has an inclined or other shaped leading edge 38, that directs a reverse sand blasting first portion 34, around the wear tip 28, and into a reverse sand blasting second portion 35, that would otherwise erode the "exposed" portion of the nozzle exterior, thus redirecting the combined flow 36, away from the exterior of the nozzle body 1.

In short the present invention provides a tool suitable for soil excavation that can be used in a number of distinct applications, wherein the tool includes a sonic or supersonic pneumatic nozzle body 1 with a wear tip 2 or 28, preferably replaceable, each part constructed of a typical nozzle material such as stainless steel, brass, aluminum, etc., where the nozzle in combination with it's wear tip, are both generally uniformly cylindrical in exterior shape, and whose wear tip outside diameter(s) is larger than any external diameter of the nozzle body.

Although the present invention has been described with particularity herein, the scope of the present invention is not limited to the specific embodiment disclosed. It will be apparent to those of ordinary skill in the art that various modifications may be made to the present invention without departing from the spirit and scope thereof. The scope of the invention is not to be limited by the illustrative examples described above. The scope of the present invention is defined by the appended claims and equivalents thereto.

What is claimed is:

1. A pneumatic nozzle assembly comprising:

A nozzle body having an internal through passage with an inlet on a first side and an outlet on an opposed side of the nozzle body, wherein the nozzle body is a converging-diverging cylindrical nozzle body having the inlet on the converging side and the outlet on the diverging side of the nozzle body, and an externally threaded nozzle connection; and A replaceable cylindrical wear tip removably coupled to the nozzle body through the nozzle body externally threaded nozzle connection and with an internal through passage aligning with the outlet of the nozzle body, and wherein an outside form of the wear tip is configured to direct reverse sand blasting particles away from the external surfaces of the nozzle body.

2. The pneumatic nozzle assembly of claim 1 wherein an outside diameter of the wear tip is greater than or equal to any external diameter of the nozzle body to direct reverse sand blasting particles away from the external surfaces of the nozzle body.

3. The pneumatic nozzle assembly of claim 2, wherein the outside diameter of the wear tip is greater than the external diameter of the nozzle body along a first section of the wear tip beginning at the end of the wear tip opposed from the nozzle body, and the wear tip further including a smooth transitional shape from a widest part of the wear tip to a distal end of the nozzle body to minimize snagging of the nozzle assembly on buried objects in use.

4. The pneumatic nozzle assembly of claim 3, wherein the internal through passage of the wear tip aligning with the outlet of the nozzle body has a diameter substantially equal to or larger than the outlet at a position adjacent the outlet.

5. The pneumatic nozzle assembly of claim 3, wherein the interior of the wear tip, closest to the nozzle body outlet, is sufficiently close to the physical inside diameter of the nozzle body outlet, whereby any rebounding air stream carrying hard particles from the ground being excavated is readily drawn into the exiting supersonic jet and ejected.

6. The pneumatic nozzle assembly of claim 3, wherein the internal through passage of the wear tip aligning with the outlet of the nozzle body has diverging shape such that any rebounding air stream carrying hard particles in that region from the ground being excavated is directed towards the exiting air jet.

7. The pneumatic nozzle assembly of claim 3, where the material of the wear tip is formed of a highly wear resistant carbide material.

8. The pneumatic nozzle assembly of claim 3 wherein the wear tip includes an intermediate adaptor attached to the nozzle body to facilitate removable attachment to the nozzle body.

9. The pneumatic nozzle assembly of claim 1 wherein a largest outside diameter of the wear tip is less than the external diameter of the nozzle body, wherein the wear tip includes a leading end of the wear tip beginning opposite of the nozzle body which is outwardly tapered from the distal end of the wear tip toward the nozzle body to direct reverse sand blasting particles away from the external surfaces of the nozzle body.

10. A supersonic nozzle assembly comprising:

A converging-diverging cylindrical nozzle body having an internal through passage with an inlet on the converging side and an outlet on the diverging side of the nozzle body and an externally threaded nozzle connection; and A replaceable cylindrical wear tip removably coupled to the nozzle body through the nozzle body externally threaded nozzle connection and with an internal through passage aligning with the outlet of the nozzle body, wherein the wear tip is formed of a material harder than the material forming the nozzle body and wherein the internal through passage of the wear tip aligning with the outlet of the nozzle body has a diameter substantially equal to or larger than the outlet at a position adjacent the outlet.

11. The supersonic nozzle assembly of claim 10, wherein a largest outside diameter of the wear tip is less than the external diameter of the nozzle body, wherein the wear tip includes a leading end of the wear tip beginning opposite of the nozzle body which is outwardly tapered from the distal end of the wear tip toward the nozzle body to direct reverse sand blasting particles away from the external surfaces of the nozzle body.

12. The supersonic nozzle assembly of claim 10 wherein an outside diameter of the wear tip is greater than or equal to any external diameter of the nozzle body to direct reverse sand blasting particles away from the external surfaces of the nozzle body.

13. The supersonic nozzle assembly of claim 12, wherein the outside diameter of the wear tip is greater than the external diameter of the nozzle body along a first section of the wear tip beginning at the end of the wear tip opposed from the nozzle body, and the wear tip further including a smooth transitional shape from a widest part of the wear tip to a distal end of the nozzle body to minimize snagging of the nozzle assembly on buried objects in use.

14. The supersonic nozzle assembly of claim 13, wherein the interior of the wear tip, closest to the nozzle body outlet, is sufficiently close to the physical inside diameter of the nozzle body outlet, whereby any rebounding air stream carrying hard particles from the ground being excavated is readily drawn into the exiting supersonic jet and ejected.

15. The pneumatic nozzle assembly of claim 13, wherein the internal through passage of the wear tip aligning with the outlet of the nozzle body has diverging shape such that any rebounding air stream carrying hard particles in that region from the ground being excavated is directed towards the exiting air jet.

16. A method of soil excavation comprising the steps of:

Providing a pneumatic nozzle assembly comprising a converging-diverging nozzle body having an internal through passage with an inlet on the converging side and an outlet on the diverging side of the nozzle body and an externally threaded nozzle connection, and a wear tip removably coupled to the nozzle body through the nozzle body externally threaded nozzle connection and with an internal through passage aligning with the outlet of the nozzle body wherein the internal through passage of the wear tip aligning with the outlet of the nozzle body has a diameter substantially equal to or larger than the outlet at a position adjacent the outlet; and Directing reverse sand blasting particles away from the external surfaces of the nozzle body through the use of the wear tip.

17. The method of soil excavation of claim 16 further comprising the step of providing supersonic flow from the pneumatic nozzle.

18. The method of soil excavation of claim 17 wherein an outside diameter of the wear tip is greater than or equal to any external diameter of the nozzle body to direct reverse sand blasting particles away from the external surfaces of the nozzle body.

19. The method of soil excavation of claim 17 wherein a largest outside diameter of the wear tip is less than the external diameter of the nozzle body, wherein the wear tip includes a leading end of the wear tip beginning opposite of the nozzle body which is outwardly tapered from the distal end of the wear tip toward the nozzle body to direct reverse sand blasting particles away from the external surfaces of the nozzle body.

* * * * *